US010703061B1

(12) United States Patent
Hovhannisyan

(10) Patent No.: US 10,703,061 B1
(45) Date of Patent: Jul. 7, 2020

(54) SUBSTANCE EXTRUDER WITH A STAND

(71) Applicant: Melik Hovhannisyan, North Hollywood, CA (US)

(72) Inventor: Melik Hovhannisyan, North Hollywood, CA (US)

( * ) Notice: Subject to any disclaimer, the term of this patent is extended or adjusted under 35 U.S.C. 154(b) by 0 days.

(21) Appl. No.: 16/354,192

(22) Filed: Mar. 15, 2019

Related U.S. Application Data

(60) Provisional application No. 62/643,664, filed on Mar. 15, 2018.

(51) Int. Cl.
*B65D 35/28* (2006.01)
*B30B 3/04* (2006.01)
*B05C 17/005* (2006.01)

(52) U.S. Cl.
CPC ..... *B30B 3/04* (2013.01); *B05C 17/005* (2013.01); *B65D 35/28* (2013.01); *B65D 35/285* (2013.01)

(58) Field of Classification Search
CPC .... B65D 35/28; B65D 35/285; B05C 17/005; B30B 3/04
See application file for complete search history.

(56) References Cited

U.S. PATENT DOCUMENTS 1,876,489 A * 9/1932 Collins ..... B65D 35/28 222/103
1,964,311 A * 6/1934 Brehm ..... B65D 35/28 222/103
2,066,245 A * 12/1936 Bauman ..... B65D 35/285 222/80
2,210,226 A * 8/1940 Weisberger ..... B65D 35/28 222/103
2,291,282 A * 7/1942 Hollebeck ..... A46B 11/0024 401/288
2,686,614 A * 8/1954 Geressy ..... B65D 35/285 222/102

(Continued)

OTHER PUBLICATIONS

Andrew Sme, "My Kid No more lazy to brush teeth misplace toothbrush—Touch Me Auto Toothpaste", Published on Oct. 7, 2015, YouTube, URL [https://www.youtube.com/watch?v=q1eUsB3RMVk], last accessed Mar. 14, 2019.

(Continued)

*Primary Examiner* — Frederick C Nicolas
(74) *Attorney, Agent, or Firm* — Phil IP Law Group Inc.; Narek Zohrabyan

(57) ABSTRACT

The extruder device with a stand is a device designed to increase efficiency of extruding substances from tube-like enclosures. The extruder device is activated by a series of leg/levers that once pushed together, engage a set of geared ratchets which in turn engages stepping gears that in turn engage torque pins which ultimately cause interlocking gear rollers to turn in clockwise and counterclockwise directions allowing the tube-like enclosure to feed through the interlocking gear rollers and thus providing the pressure to extrude the contents of the tube-like enclosures. Because of its simple design, minimal force is required to activate the mechanism thereby extruding the substance of the tube-like enclosure in an efficient and uniform manner. The already spent tube-like enclosure is collected in an enclosed cavity and at the end, disposed of once the unit is opened with relative ease.

8 Claims, 4 Drawing Sheets

(56) References Cited

U.S. PATENT DOCUMENTS 3,289,893 A * 12/1966 Vance ..... B65D 35/285 222/102
3,586,213 A * 6/1971 Gill ..... B65D 35/285 222/102
3,946,904 A * 3/1976 Mulakala ..... B65D 35/285 222/102
3,970,220 A * 7/1976 Spears ..... B65D 35/285 222/102
4,030,636 A * 6/1977 Drancourt ..... B65D 35/285 222/102
4,326,647 A * 4/1982 Pool ..... B65D 35/28 222/103
4,354,623 A * 10/1982 Gill ..... B65D 35/285 222/102
4,978,034 A * 12/1990 Vishnevetsky ..... B65D 35/285 222/102
5,195,659 A * 3/1993 Eiskant ..... B65D 35/285 222/102
5,431,304 A * 7/1995 Gentile ..... A47K 5/122 222/103
5,447,255 A * 9/1995 Smedley ..... B65D 35/285 222/102
5,497,913 A * 3/1996 Baker ..... A61C 9/0026 222/102
6,315,165 B1 * 11/2001 Regan ..... B65D 35/28 222/103
6,378,732 B1 * 4/2002 Park ..... B65D 35/285 222/102
6,669,055 B1 * 12/2003 Coleman ..... B65D 35/28 222/103
6,948,636 B1 * 9/2005 Fischer ..... A61M 5/148 222/103
7,934,864 B2 * 5/2011 Heusser ..... B01F 5/064 206/222
8,434,644 B1 * 5/2013 Galante ..... B65D 35/285 222/102

OTHER PUBLICATIONS

Daiso Australia, "Toothpaste Squeezer / Tube Winder", Published on Apr 24, 2015, YouTube, URL [https://www.youtube.com/watch?time_continue=1&v=zEvQtHIHrOc], last accessed Mar. 14, 2019.

Tuberocked, "Aluminum Squeezer— выжималка диспенсер для тюбиков", Published on Sep 24, 2018, YouTube, URL [https://www.youtube.com/watch?v=5Ep4I5BEZos], last accessed Mar. 14, 2019.

Gadget Addict, 3D Printed Toothpaste Squeezer, Published on Mar 22, 2015, YouTube, URL [https://www.youtube.com/watch?v=1OH5SG6YhYg], last accessed Mar. 14, 2019.

Everyday's Solutions, "Rolling Toothpaste Dispenser", Published on Feb. 3, 2019, YouTube, URL [https://www.youtube.com/watch?v=xUzP1_Cbo1o], last accessed Mar. 14, 2019.

* cited by examiner

SUBSTANCE EXTRUDER WITH A STAND

RELATED APPLICATIONS

The present application claims the benefit of, and priority to U.S. Provisional Application No. 62/643,664 filed Mar. 15, 2018, the contents of which are hereby incorporated herein by reference in its entirety.

BACKGROUND OF THE INVENTION

Many substances are stored and distributed in tube-like enclosures made of varying materials such as metal, plastic, thin film, or other semi-rigid materials that are difficult to manually manipulate. When the substance is squeezed by hand, some of the substance is inevitably left in the tube, resulting in waste. This is because it is hard to consistently and uniformly push out the contents of these tubes using two hands. More unclaimed and wasted substance means the consumer buys more of these substance filled tubes in a more frequent basis. Thereby requiring manufacturers to produce more tubes containing various substances for public consumption. This increases the environmental impact to our planet due to the "over production" of these tubes and their inefficient use.

The inefficient use of these tubes is prevalent amongst a certain group of consumers. The inability to completely extrude all the contents of these tubes is a key problem for the consumer. This is especially the case with children, elderly people, people with disabilities, those who have medical conditions such as diabetes, Parkinson's disease, osteoporosis, joint aches, or situations where people have limited dexterity.

Additionally, substances, such as toothpaste, that are stored in these tubes are usually placed on or around the sink. Usually the tubes are left near the sink in a bathroom, or sometimes in a cup adjacent to toothbrushes. These locations provide a rich environment for bacteria to flourish and makes extracting the contents of the tubes very unsanitary. To address some of these issues, some have developed devices with that goal in mind.

For example one common device used only for dispensing toothpaste in an automatic fashion, uses vacuum technology. This device and its variants, dispense a small portion of toothpaste at a time. It employs an inside chamber where the toothpaste is dispensed, which needs constant cleaning due to the accumulation of toothpaste remnants and dirt. Furthermore, this device is affixed on a wall and cannot be readily relocated. Moreover, this device requires the user to use a lot of energy and effort in order to insert the tube in its proper place before it can dispense the substance. This inevitably provides a barrier for children, people of limited ability to use their hands and fingers to properly install and use this device.

Other devices also exist requiring the flat end of the tube to be placed in a longitudinal side opening of a cylindrical device. The substance inside of the tube is expelled by turning a side knob located at the end of the cylindrical device. This device has its limitations, such as requiring the user to use both hands to operate it. Furthermore, people with limited dexterity still may not be able to turn the knob to activate the mechanism for extruding the substance. Finally, this device is designed to be hanged from its hook that is affixed on a flat surface such as a mirror.

Another device requires placing the end of a tube between two interlocking gear rollers. These interlocking gear rollers have to be held together tightly by using one hand to clasp the extended frames of the device. The device requires holding it in one hand while the other hand turns a key that feeds the tube into and between the two interlocking gear rollers. The combination of clasping the device with one hand and turning the key with the other hand allows the substance of the tube to be extruded. This too has its limitations since it requires two hands to operate the device, the inability to use the device as a stand and therefore making it unsanitary, and requiring the user to exert substantial amount of force on the key. The complicated nature of the device makes it undesirable for children and people of limited dexterity and agility in manipulating their hands and fingers.

Another device requires sliding the flat end of the tube into a thin slit. This device is then pushed up to the opening end of the tube. This manipulation puts pressure from the outside surfaces of the tube material, thereby resulting in moving the substance closer to the opening of the tube and expelling it. This device is a small flat plate with a slit and does not serve as a means to keep the tube on a stand or to store it in a sanitary condition. Furthermore, the user still has to use both hands to operate extruding the contents of the tube. One hand to hold the tube and another to slide the plate over it.

Despite these examples, there exists a long-felt and ongoing need for a new and improved system for dispensing contents of a tube with little effort and manual dexterity, where anyone can use it including children, people with medical conditions or limited dexterity, without wasting residual material left in the tube, with an individual stand or ability to hang it on a wall reducing contamination, where the loading and disposing of the tube is effortless, basic, where various sized tubes and a variety of material used to construct it can be compatible, where the user only uses one hand to extrude the contents, and where the device is also environmentally less impactful because it limits the amount of tubes necessary for production. The substance extruder of this application provides all of those benefits.

SUMMARY OF THE INVENTION

The extruder device with a stand is a device designed to increase efficiency of extruding substances from tube-like enclosures. Additionally, the device allows a consumer to readily use it in various positions and using only one hand. The device is also designed to be a stand for whatever tube-like enclosure is inserted in it. The device further allows the collection of the already spent tube-like enclosure in a safe and easy manner. The device can be used by almost any consumer whether it is a child, a disabled individual, an elderly, or a person of limited dexterity.

The extruder device also allows the consumer to store it in a location where the contents of the tube-like enclosure are safe from contamination. The device also allows the user to color code it based on the contents of the tube-like enclosure.

Because consumers can use this device on various types of tube-like enclosures that may contain various types of substances, the production of these tubes is significantly reduced because the contents are extrude with high efficiency. In some trials, it was determined that between 5%~10% more substance was extruded due to the highly efficient extruding ability of the device.

The extruding device is also very simple to use and does not require regular maintenance unlike other devices available in the marketplace.

The extruder device is activated by a series of leg/levers that once pushed together engage a set of geared ratchets which in turn engage stepping gears that in turn engage torque pins which ultimately cause interlocking gear rollers to turn in clockwise and counterclockwise directions allowing the tube-like enclosure to feed through the interlocking gear rollers and thus providing the pressure to extrude the contents of the tube-like enclosures.

BRIEF DESCRIPTION OF THE DRAWINGS

Embodiments in accordance with the present invention are shown in the drawings and will be described below with reference to the figures, whereby elements having the same effect have been provided with the same reference numerals. The following is shown.

DETAILED DESCRIPTION

Figure 1:
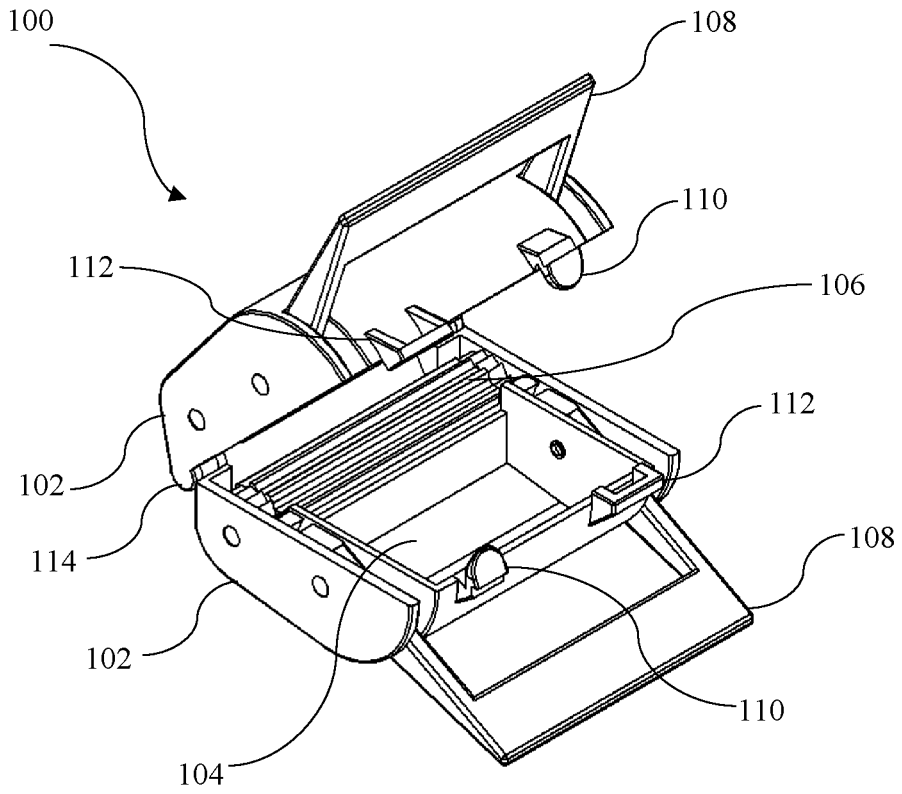
FIG. 1 shows a partially opened perspective view of the substance extruder with a stand device described by this invention.

An embodiment of the substance extruding device is described herein. The device is used to dispense incremental amounts of a substance such as paint, glue, toothpaste, cream, paste, and any viscous substance that is captured in a tube-like enclosure. The tube-like enclosures may be made of a plastic, polymer, paper, aluminum, rubber, metal or metal alloy. The device is designed in such a way as to allow the user to only extrude enough substance for use without spilling or wasting any of it. Furthermore, the device is specially designed to serve both as an extruder as well as a stand for the tube-like enclosure. Additionally, the device incorporates a depositing chamber which captures the expended tube-like material opposite to the dispensing end. Finally, the device easily opens up in order to access the depositing chamber allowing a user to discard the empty tube-like enclosure after all the substance has been extruded.

The device is specially designed to be used in many applications such as for painting of art works, dispensing adhesive material for use in arts and crafts, dispensing toothpaste, creams, and lotions for an average consumer. Additionally, the device can be color coded to allow for immediate identification of the tube-like enclosure that holds the germane substance or, the device can be transparent to allow the user to view the contents of the tube-like enclosure. Furthermore, the device allows the user to store the tube-like enclosure in an upright position with use of the integrated multifunction legs that also act as levers at the time of extruding.

The device is operated with application of minimal force and requires only mechanical components to extrude a substance from the tube-like enclosure. Mechanical components work in unison to advance the tube-like enclosure in the device, thereby, enabling the substance to flow out of the top of the tube-like opening. The device provides an efficient, economic, and environmentally friendly way to extrude the substance of the tube-like enclosure without creating messy application of the substance. This advantage is obtained because the interlocking gear rollers grip the tube-like enclosure and allow the substance to be squeezed out evenly. The device contains device bodies, interlocking gear rollers, fulcrum pins, tension springs, advancing ratchets, advancing pins, stepping gears and legs/levers. These components are illustrated in the drawings in further detail.

An embodiment of the substance extruding device can be color coded to differentiate one device from another, depending on what tube-like enclosure is inserted into the device. Because the tube-like enclosure temporarily remains in the device, it is not necessary to open the device in order to observe the type, brand, or make of the substance contained within the tube-like enclosure captured within the depositing chamber. The color coding of the device indicates to the user the type of substance that will be extruded by that particular device.

An embodiment of the substance extruding device can be made of a transparent material such as plastic, Plexiglas, fiberglass, acrylic, glass or any type of Poly Methyl Methacrylate (PMMA) type acrylic sheet such that a user can differentiate between one device from another depending on what tube-like enclosure is inserted into the device.

An embodiment of the substance extruding device has a thumb locking feature which allows the user to open the device. The opposite end of the device is held together by a swivel hinge that may be used with a pin, leaf, or with a bushing structure. After opening the device, the user has essentially halved the device into its device body and the mechanical components contained therein. This allows the user to access the depositing chamber and discard the empty tube-like enclosure.

One embodiment of the substance extruding device made of a plastic material allows for tube-like enclosures with a width of up to 65 mm to fit through the gear rollers. Furthermore, this embodiment can accommodate tube-like enclosures with a thickness of from 0.2 mm to a 0.4 mm. However, depending on the dimensions of the parts used to construct the substance extruder with stand, other dimensioned tube-like enclosures can be accommodated. The invention here does not limit the size and make of the arts which dictate which tube-like enclosures it will be compatible with. No limitations are intended here.

FIG. 1 illustrates a substance extruder device with a stand (100). The substance extruder device with a stand (100) has two device bodies (102) shown in a partially opened position when they are interlocked together. The device body (102) can be made of a solid substance such as plastic, metal, metal allow, wood, Plexiglass, acrylic, glass, fiberglass or any type of Poly Methyl Methacrylate (PMMA) type acrylic sheet. Each of the device body (102) holds the mechanical components which allow the device to function. The device body (102) also forms the depositing chamber (104) after both device body (102) sections come together to lock into one complete unit, thereby, making up the substance extruder device with a stand (100). Each device body (102) has compartments which allows some of the mechanical components (106) to be inserted into place. Furthermore, each device body (102) has side channels that allow the legs/levers (108) to be inserted and fastened to the device body (102) in conjunction with various other mechanical components (not described here). Finally, each device body (102) has a thumb latch (110) and a latch retention plate (112). The thumb latch (110) and latch retention plate (112) of one device body (102) are integrated in diametrically opposing configuration such that the thumb latch (110) of one device body (102) locks into the latch retention plate (112) of the other device body (102) when each device body (102) section comes together to make up the substance extruder device with a stand (100). Similar relationship is shown with regard to the latch retention plate (112) of one device body (102) and the thumb latch (110) of the other device body (102). The opposite end of each device body (102) is where the swivel hinge (114) holds the substance extruder device with a stand (100) together.

Figure 2:
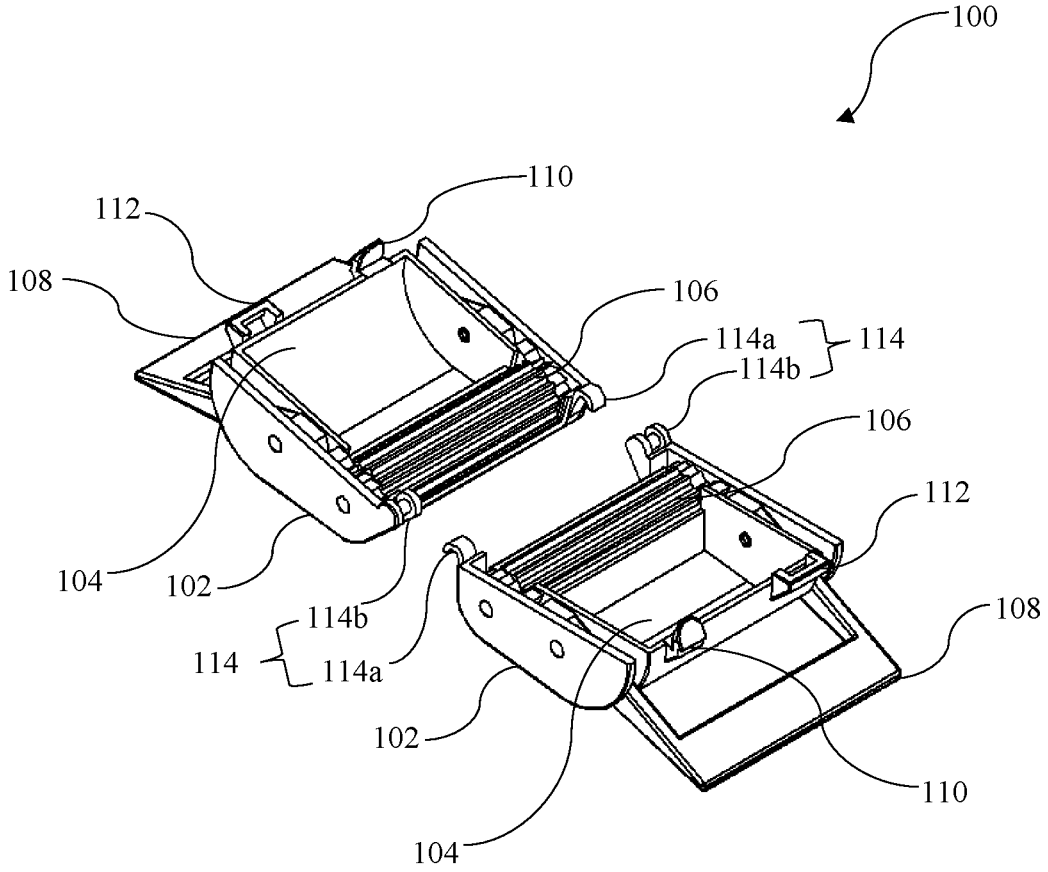
FIG. 2 shows a completely opened perspective view of the substance extruder with a stand device described by this invention.

FIG. 2 illustrates the substance extruder device with a stand (100) as it is completely open. As previously discussed, the substance extruder device with a stand (100) has two device bodies (102) shown in a partially opened position. The device body (102) can be made of a solid substance such as plastic, metal, metal allow, wood, Plexiglas, acrylic, glass, fiberglass or any type of Poly Methyl Methacrylate (PMMA) type acrylic sheet. Each of the device body (102) holds the mechanical components which allow the device to function. The device body (102) also forms the depositing chamber (104) after both device body (102) sections come together to lock into one complete unit making up substance extruder device with a stand (100). Each device body (102) has compartments which allows some of the mechanical components (106) to be inserted into place. Furthermore, each device body (102) has side channels that allow the legs/levers (108) to be inserted and fastened to the device body (102) in conjunction with various other mechanical components (not described here). Finally, each device body (102) has a thumb latch (110) and a latch retention plate (112). The thumb latch (110) and latch retention plate (112) of one device body (102) are integrated in diametrically opposing configuration such that the thumb latch (110) of one device body (102) locks into the latch retention plate (112) of the other device body (102) when each device body (102) section come together to make up the substance extruder device with a stand (100). Similar relationship is shown with regard to the latch retention plate (112) of one device body (102) and the thumb latch (110) of the other device body (102). The opposite end of each device body (102) is where the swivel hinge (114) holds the substance extruder device with a stand (100) together.

In an embodiment, the swivel hinge (114) incorporates a male leaf (114*a*) and a female leaf (114*b*). The male leaf (114*a*) and female leaf (114*b*) of one device body (102) are integrated in diametrically opposing configuration such that the male leaf (114*a*) of one device body (102) locks into the female leaf (114*b*) of the other device body (102) when each device body (102) section comes together to make up the substance extruder device with a stand (100). Similar relationship is shown with regard to the female leaf (114*b*) of one device body (102) and the male leaf (114*a*) of the other device body (102).

Figure 3:
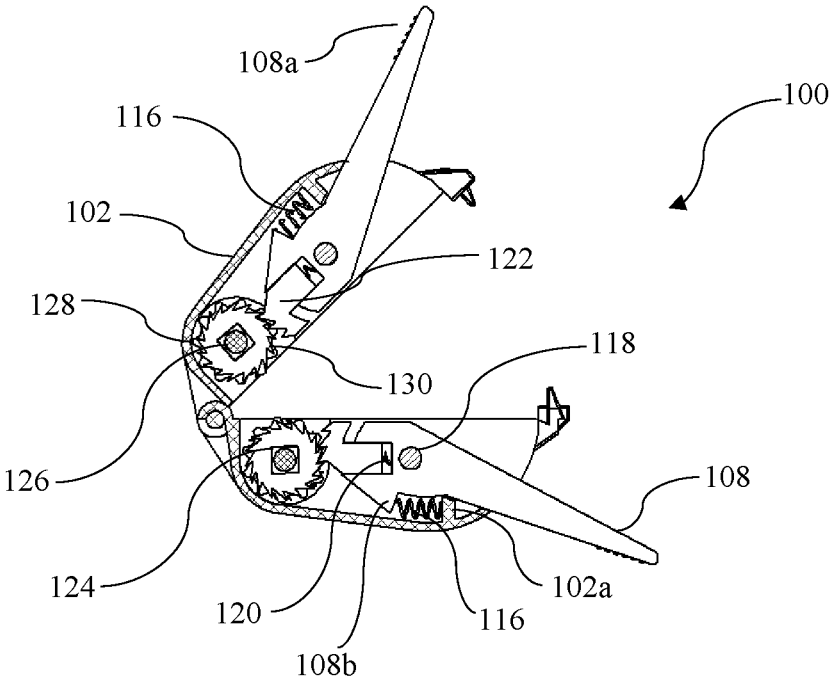
FIG. 3 is cut off cross sectional view of the substance extruder with a stand device described by this invention.

FIG. 3 is a cross sectional view of the substance extruder device with a stand (100) that is partially open. For purposes of brevity, some components are referenced once, even though the same parts are contained within each device body (102). The substance extruder device with a stand (100) depicts the legs/levers (108) with incorporated ridges or textured surface features (108*a*) which allow the user to grip the legs/levers with two or three fingers of either hand. By holding the legs/levers (108) using for example the thumb and index finger (or index finger and the middle finger), the user can squeeze the opposite facing legs/levers (108) inwards, towards each other, in order to activate the mechanical components and thereby pull the tube-like enclosure (not shown) and extrude the substance.

The mechanical components are shown as: interlocking gear roller (128), fulcrum pin (118), lower tension spring (116), mid tension spring (120), upper tension spring (126), advancing ratchet (122), torque pin (124), stepping gear (130), and the legs/levers (108). The fulcrum pin (118) is used to fasten the sides of the legs/levers (108) unto the device body (102). The fulcrum pin (118) also acts as a swivel point. Under the internal side of the legs/levers (108) and capped in between the inner boundary (102*a*) of the device body (102) and the "key-notch" (108*b*), lies the lower tension spring (116). The lower tension spring (116) is sandwiched in between the inner boundary (102*a*) and the "key-notch" (108*b*) such that the lower tension spring (116) has limited movement. The lower tension spring (116) is activated when the legs/levers (108) are pressed together in an inwardly direction, thereby tensioning the lower tension spring (116). Once tensioned, the lower tension spring (116) will then default to its natural position, which releases the tension on the lower tension spring (116). On the legs/levers (108), there exists a cavity where the mid tension spring (120) is inserted in. The three sided cavity limits and guides the movement of the mid tension spring (120). The advancing ratchet (122) caps the other end of the mid tension spring (120). The advancing ratchet (122) has saw-teeth on the opposite end which meets and interlocks with the stepping gear (130). Once the legs/levers (108) are squeezed in towards one another, the advancing ratchet (122) advances the stepping gear (130) uni-directionally in the clockwise direction. This action provides the force necessary to move the tube-like enclosure (not shown) through the pair of stepping gear (130) components and allows for the substance to be extruded out of the tube-like enclosure. Throughout this process, the mid tension spring (120) provides enough lateral force so that the stepper gear (130) engages or disengages by advancing or staying stationary while the legs/levers (108) go back to their default position. The stepper gear (130) has a square like clearing in the center of the component, which allows the stepper gear (130) to fasten unto the torque pin (124). When the stepper gear (130) is activated as a result of squeezing in the legs/levers (108), the torque pin (124) moves in unison in a clockwise direction. The torque pin (124) fits snug into the interlocking gear roller (128) because the interlocking gear roller (128) also has a square shaped clearing in the center of the component. When the stepper gear (130) moves, the torque pin (124) also moves which results in the interlocking gear roller (128) moving in unison and in the same direction as the stepper gear (130) and the torque pin (124). Each interlocking gear roller (128) has two torque pins (124) inserted from either end met in the middle only with one upper tension spring (126). The upper tension spring (126) provides enough tension so that the interlocking gear roller (128), the torque pin (124) and the stepper gear (130) will stay loaded to further provide a means to completely disassemble this section of the mechanical component for maintenance.

The relationship between the amount of pressure that is applied to the legs/levers (108) and the amount of pressure exerted on the interlocking gear rollers (128) is governed by the following formula:

$$P_1 \times L_1 = P_2 \times L_2$$

$$L_1 = 2.9 \times L_2$$

$$P_1 \times 2.9 \times L_2 = P_2 \times L_2$$

$$P_1 \times 2.9 = P_2 \quad \text{(i)}$$

$$P = 2 \times P_2$$

$$P=2\times2.9P_1$$

$$P=5.8\times P_1 \quad \text{(ii)}$$

Where P1 is the pressure put on legs/levers gear rollers, L1 is the distance from the legs/levers to the fulcrum, P2 is the pressure outputted on the torque pins and L2 is the distance from the fulcrum pin to the ends of the leg components. Where P2 is equally divided on the four stepping gears which is the reason the power on the shafts increases. Wherein P is the final power output of the combined interlocking gear rollers.

Figure 4:
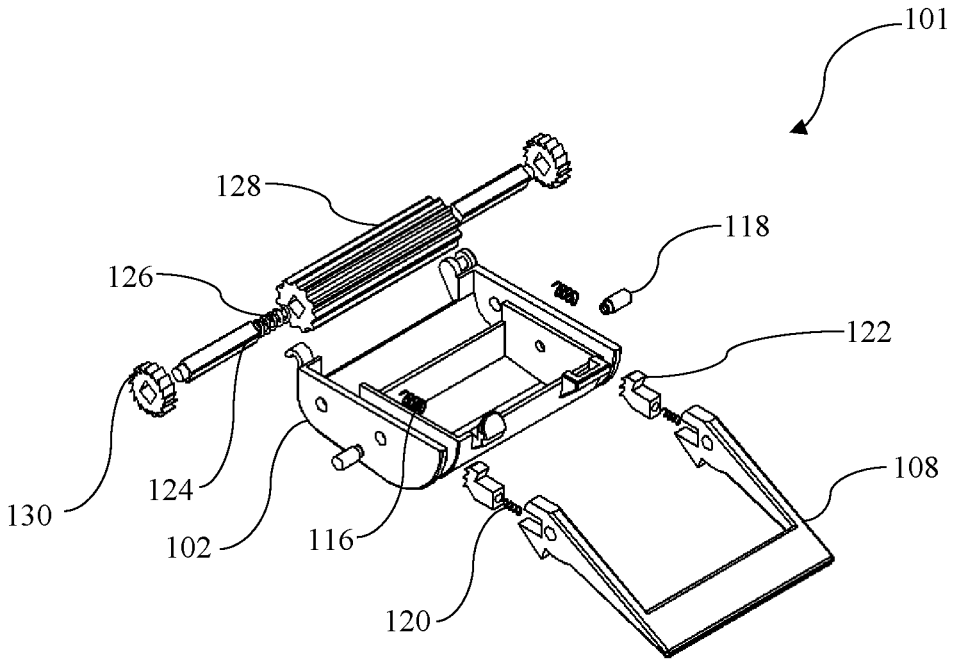
FIG. 4 is an exploded perspective view of one-half section of the substance extruder with a stand device described by this invention.

FIG. 4 shows an exploded view of one-half section (101) of the device body with a stand (100). The figure illustrates how the device body (102) houses all the various mechanical components such as: interlocking gear roller (128), fulcrum pin (118), lower tension spring (116), mid tension spring (120), upper tension spring (126), advancing ratchet (122), torque pin (124), stepping gear (130), and the legs/levers (108).

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A substance extruder device with a stand used to extrude substances from tube-like enclosures comprising:

two individual device bodies;

each device body has a cavity on one side;

the device bodies mate together by swivel hinges located on one end of the device bodies and the mating is secured by a locking mechanism located on the opposite ends of the device bodies;

the mated device bodies create an enclosed cavity;

a multitude of channels run parallel to the swivel hinges and extend out from the end of the device body where the locking mechanism are located;

each device body has leg components that fit into the channels and extend out of the device body and terminate to create a lever; and the legs are attached to the device body on a fulcrum, allowing the legs to swivel and move in one direction.

2. The substance extruder device with a stand of claim 1, wherein:

each device body houses an interlocking gear roller placed at the end of the device body where the swivel hinges are located;

the interlocking gear roller has a polygonal shaped opening running through its center; and the interlocking gear roller has saw teeth distributed along the outer surface of the interlocking gear roller.

3. The substance extruder device with a stand of claim 2, wherein:

the interlocking gear roller contains an upper tension spring inserted through the polygonal shaped opening;

at each end of the upper tension spring, a polygonal shaped torque pin is placed in the polygonal shaped opening; and each of the polygonal shaped torque pins fit through the polygonal shaped opening, allowing some free movement of the polygonal shaped torque pins.

4. The substance extruder device with a stand of claim 3, wherein:

outer ends of both of the polygonal shaped torque pins have a section that has a circular shape;

each of the circular shapes has a cross-sectional profile smaller than the cross-sectional profile of the rest of the polygonal shaped torque pins;

each outer end of each polygonal shaped torque pin is mated with a stepping gear;

the stepping gear has a polygonal shaped opening at the stepping gear's center that fits over the polygonal shaped torque pin, allowing some free movement of the polygonal shaped torque pin;

each stepping gear slides over the outer end of the polygonal shaped torque pin and unto the polygonal shaped torque pin in order to mate with the polygonal shaped torque pin;

the stepping gear has directional saw teeth that are slanted to allow the stepping gear to move in one direction;

the combination of the interlocking gear roller, the upper tension spring, the pair of polygonal shaped torque pins and the pair of the stepping gears are placed in an opening cutout in the device body; and the circular shape of the polygonal shaped torque pin goes through a matching circular cutout in the device body and terminates at the inside wall of the device body's opening cutout.

5. The substance extruder device with a stand of claim 4, wherein:

the fulcrum of the leg components that are attached to the device body are effectuated by fulcrum pins; and each fulcrum pin goes through each leg component and through the wall of the device body and an inside wall of the device body which creates the channel.

6. The substance extruder device with a stand of claim 5, wherein:

each leg component housed inside the device body and fitted in the channel has a rectangular "U" shaped cutout;

each leg component housed inside the device body and fitted in the channel also has a triangularly shaped key-notch; and the triangularly key-notch serves as a limiting wall for a lower tension spring set in between the triangularly key-notch and an inner boundary located within the device body.

7. The substance extruder device with a stand of claim 6, wherein:

a mid tension spring is inserted into the rectangular "U" shaped cutout;

the mid tension spring is held in place at the mid tension spring's non-terminating end by an advancing ratchet;

one end of the advancing ratchet that does not come into contact with the mid tension spring has an angled saw tooth matching the angled sawteeth of the stepping gear; and the advancing ratchet allows the stepping gear to move in only one direction by use of the advancing ratchet's saw tooth and stepping gear's angled saw teeth.

8. The substance extruder device with a stand of claim 6, wherein:

the substance extruder device with a stand is activated by pushing the levers towards each other;

once the levers are pushed in towards each other, the leg components turn about the fulcrum;

this motion causes the advancing ratchets to engage the stepping gears;

the stepping gears in lock-step turn the polygonal shaped torque pins; and the polygonal shaped torque pins engage the interlocking gear rollers which turn synchronously where one interlocking gear roller turns counterclockwise and the other interlocking gear roller turning clockwise thus feeding the tube-like enclosure through and depositing the empty tube-like enclosure in the enclosed cavity and at the same time extruding the substance contained within the tube-like enclosure.

* * * * *